United States Patent [19]

Sitzler

[11] Patent Number: 4,705,338

[45] Date of Patent: Nov. 10, 1987

[54] ZERO INSERTION FORCE CONNECTOR

[75] Inventor: Fred C. Sitzler, Dillsburg, Pa.

[73] Assignee: E. I. Du Pont de Nemours and Company, Wilmington, Del.

[21] Appl. No.: 808,926

[22] Filed: Dec. 13, 1985

[51] Int. Cl.[4] ..... H01R 9/09

[52] U.S. Cl. ..... 439/260; 439/630

[58] Field of Search ..... 339/74 R, 75 MP, 176 MP

[56] References Cited

U.S. PATENT DOCUMENTS

| | | | |
|---|---|---|---|
| 3,710,303 | 1/1973 | Gallager, Jr. | 339/176 MP |
| 3,899,234 | 8/1975 | Yeager et al. | 339/74 R |
| 4,085,990 | 4/1978 | Jayne | 339/74 R |
| 4,188,085 | 2/1980 | Aldridge et al. | 339/176 MP |
| 4,196,955 | 4/1980 | Anhalt | 339/74 R |
| 4,428,635 | 1/1984 | Hamsher, Jr. et al. | 339/74 R |
| 4,480,884 | 11/1984 | Babuka et al. | 339/176 MP |
| 4,542,950 | 9/1985 | Gillett et al. | 339/176 MP |
| 4,544,223 | 10/1985 | Gillett | 339/176 MP |
| 4,548,452 | 10/1985 | Gillett | 339/176 MP |
| 4,586,772 | 5/1986 | Cobaugh et al. | 339/75 MP |

FOREIGN PATENT DOCUMENTS

| | | | |
|---|---|---|---|
| 121000 | 10/1984 | European Pat. Off. | 339/75 MP |
| 3421093 | 12/1984 | Fed. Rep. of Germany . | |

*Primary Examiner*—John McQuade

[57] ABSTRACT

A zero insertion force connector for a printed circuit card. The connector has opposed rows of terminals having normally spaced contacts at the ends of outwardly bowed portions. Cams and followers are located beneath the bowed portions in positions where the followers can engage the bowed portions, engage the contacts with an inserted card and then stress the bowed portions, supplying contact normal force and contact wipe.

6 Claims, 8 Drawing Figures

| Fig. 2A | Fig. 2B |
|---|---|

ZERO INSERTION FORCE CONNECTOR

BACKGROUND

This invention relates generally to electrical connectors and, more particularly, to connectors into which the edge of a printed circuit card can be inserted with zero insertion force.

It is known in the art that such connectors can be provided with cams and followers for spreading opposed rows of terminals when a card is to be inserted or removed. For example, cams for tensioning as well as spreading the terminals have been disclosed by Hamsher et al. in U.S. Pat. No. 4,428,635. In this connector, all of the normal contact force must be supplied at the terminal block, thus requiring thick, costly material in the terminals to obtain that force. Also, the frictional force of the cam followers on the insides of the free ends of the cantilevered arms must be counteracted before a normal force is applied.

SUMMARY

The above and other difficulties have been overcome in an edge card connector of the type having opposed rows of elongated terminals having spaced contacts at their free ends, a cam extending lengthwise of the rows and an elongated cam follower for each row of terminals. The followers are located outside the rows, beneath outwardly bowed portions in the lengths of the terminals, and are adapted to engage the bowed portions and move them into engagement with an inserted card. Then, the bowed portions are stressed to achieve a contact wipe.

Shank portions of the terminals extend through a terminal block and present rows of projecting tails below the block adapted for connection to a circuit board. The cam followers are enclosed within a one-piece, non-moving housing. The housing has walls attached to the sides of the terminal block and has top and end walls which are slotted to receive the card. The terminals emerge from the top surface of the terminal block in two rows, and the cams are longitudinally movable in channels defined by the rows of terminals, the housing and the top surface of the terminal block.

DRAWINGS

DESCRIPTION

Figures 1, 2:
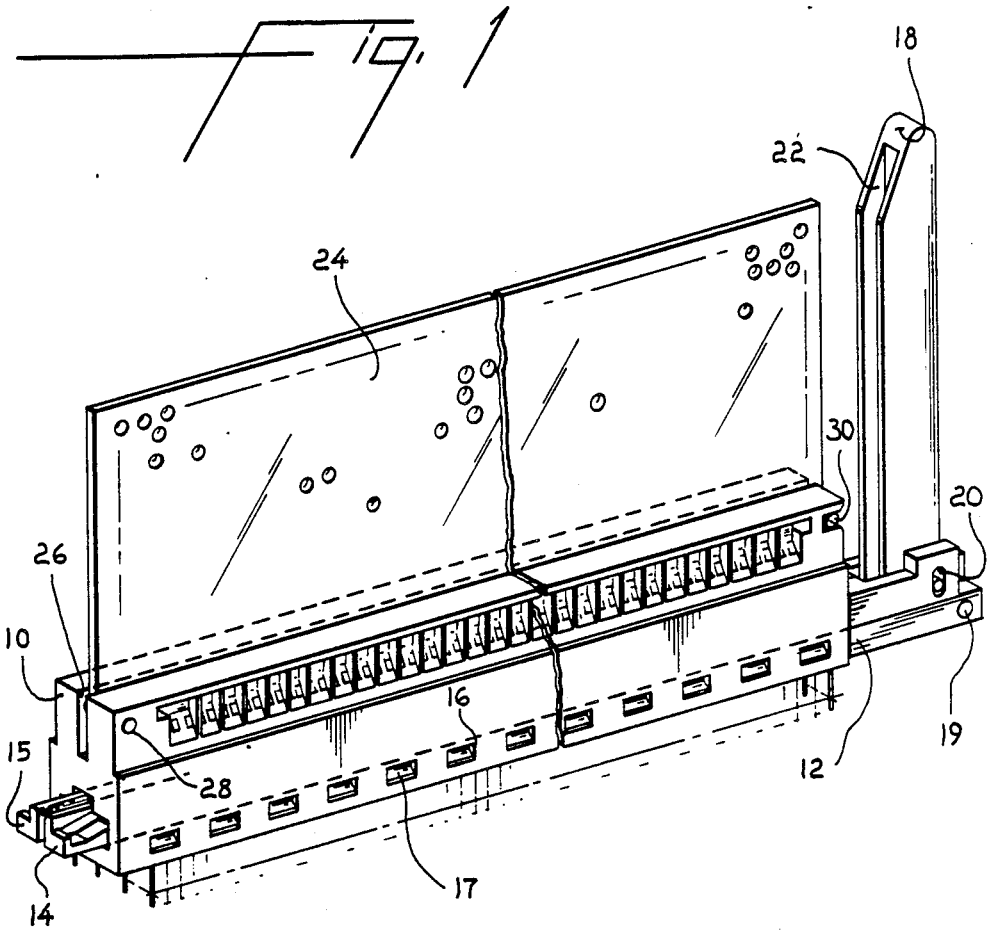
FIG. 1 is a perspective view of the edge card connector of the present invention.
FIG. 2 is a schematic representation of the relationship between FIGS. 2A and 2B.

Referring to FIG. 1, the edge card connector is shown to include a housing 10 for a terminal block 12 and cams 14,15. Housing 10 has openings 16 for detents 17 on terminal block 12. A handle 18 is pivotally attached at 19 to block 12 and has pins fitted into slots 20 in the cams. Handle 18 is grooved, as shown at 22, to receive one edge of a printed circuit card 24 when the handle is down to a horizontal position. From there, card 24 can be pushed laterally into an open-ended slot 26 in the top wall of housing 10 to the point where it is stopped by a pin 28 and another pin 30 on the card is seated in notches at the other end of housing 10. Then, cams 14,15 are moved to the positions shown in FIG. 1 by raising handle 18.

Figure 2A:
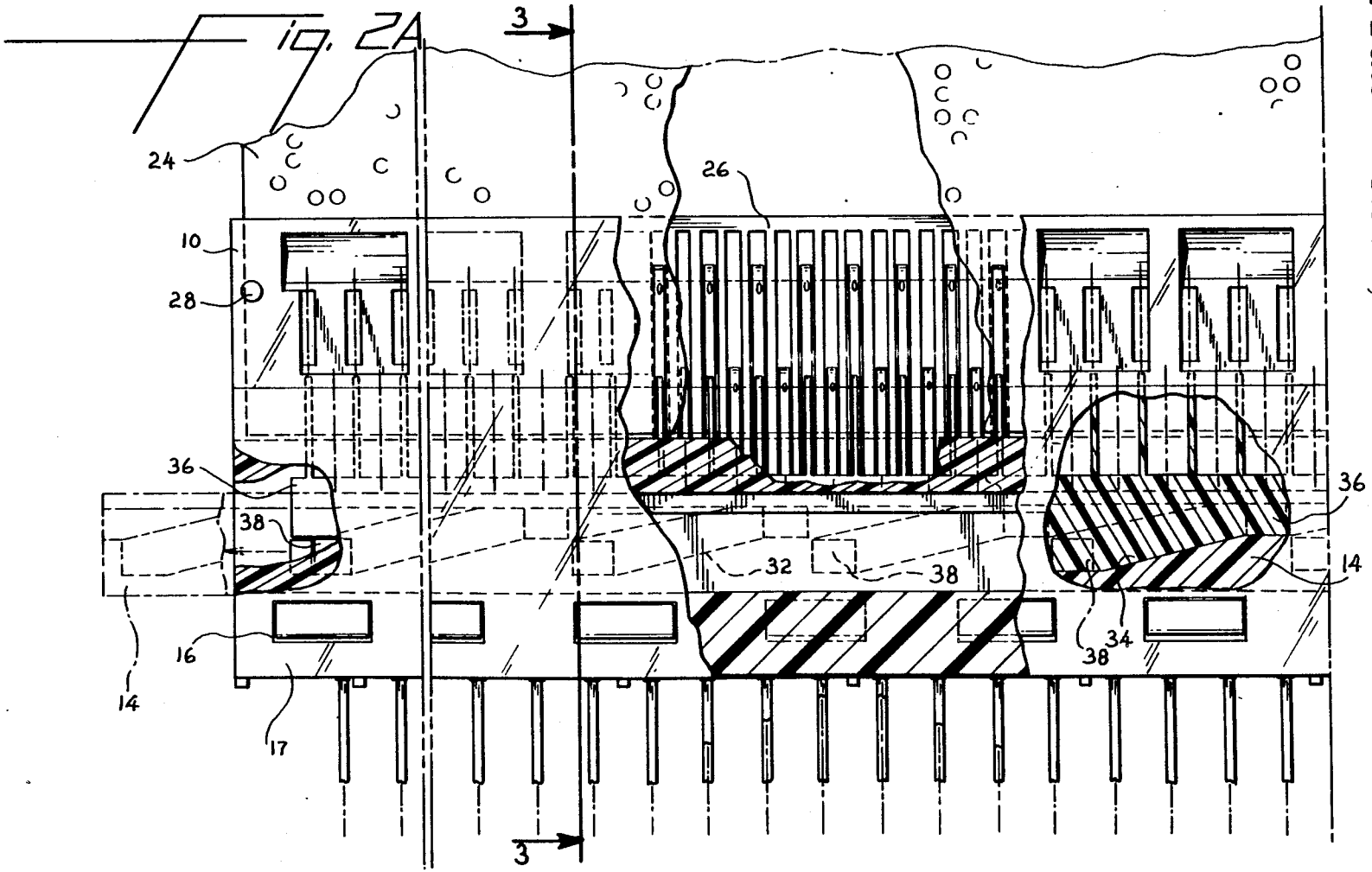
FIG. 2A is a fragmentary, side view of the connector shown in FIG. 1, parts having been broken away and shown in section. The sections have been taken on irregular line 2A—2A in FIG. 3.
Figure 2B:
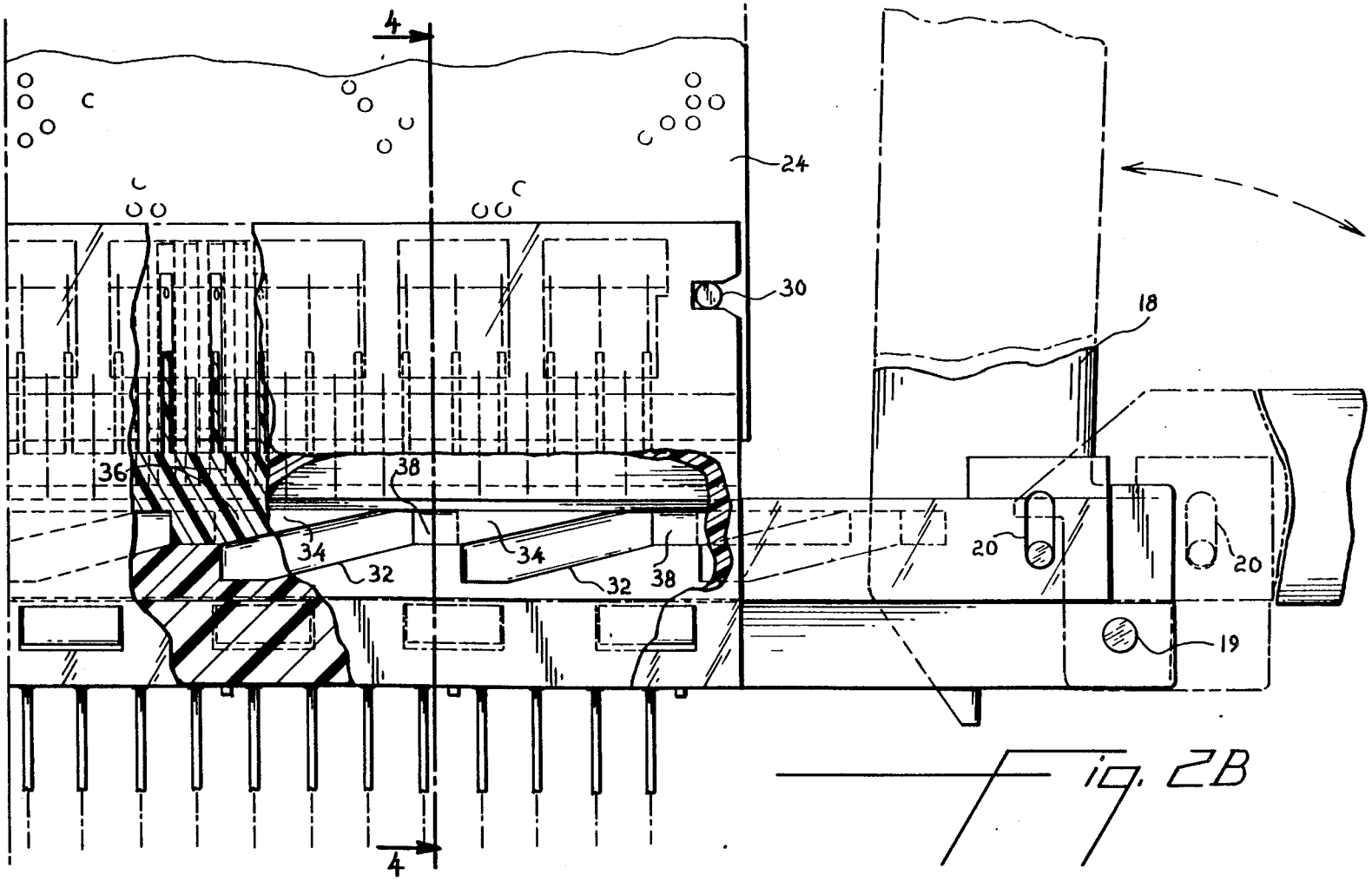
FIG. 2B is a similar view, the sections having been taken on line 2B—2B in FIG. 4.

As shown in FIGS. 2A and 2B, cam 14 has ramps 32 which coact with similarly but oppositely configured projections 34 on a cam follower 36 in housing 10. Fingers 38 on follower 36 limit the movements of cam 14 which movements raise and lower the follower. Follower 36 is shown in its lowered position in FIG. 2A and in the raised position in FIG. 2B.

Figure 3:
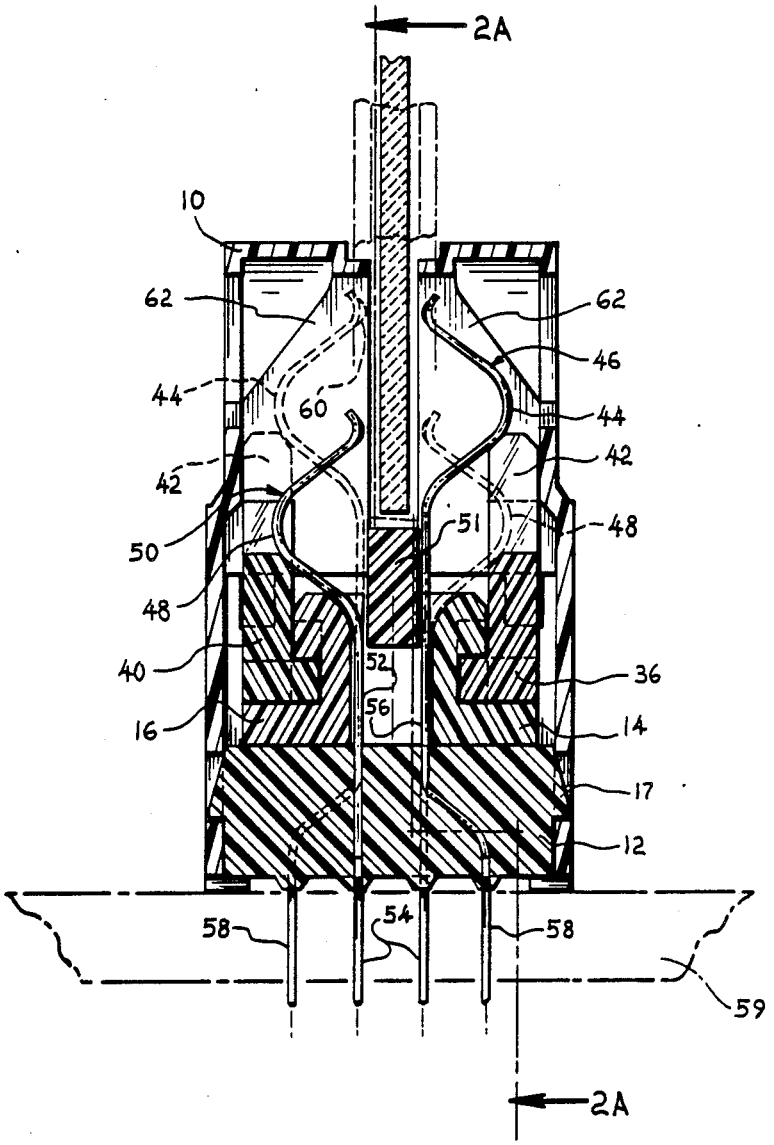
FIG. 3 is a transverse, sectional view taken on line 3—3 in FIG. 2A.
Figure 4:
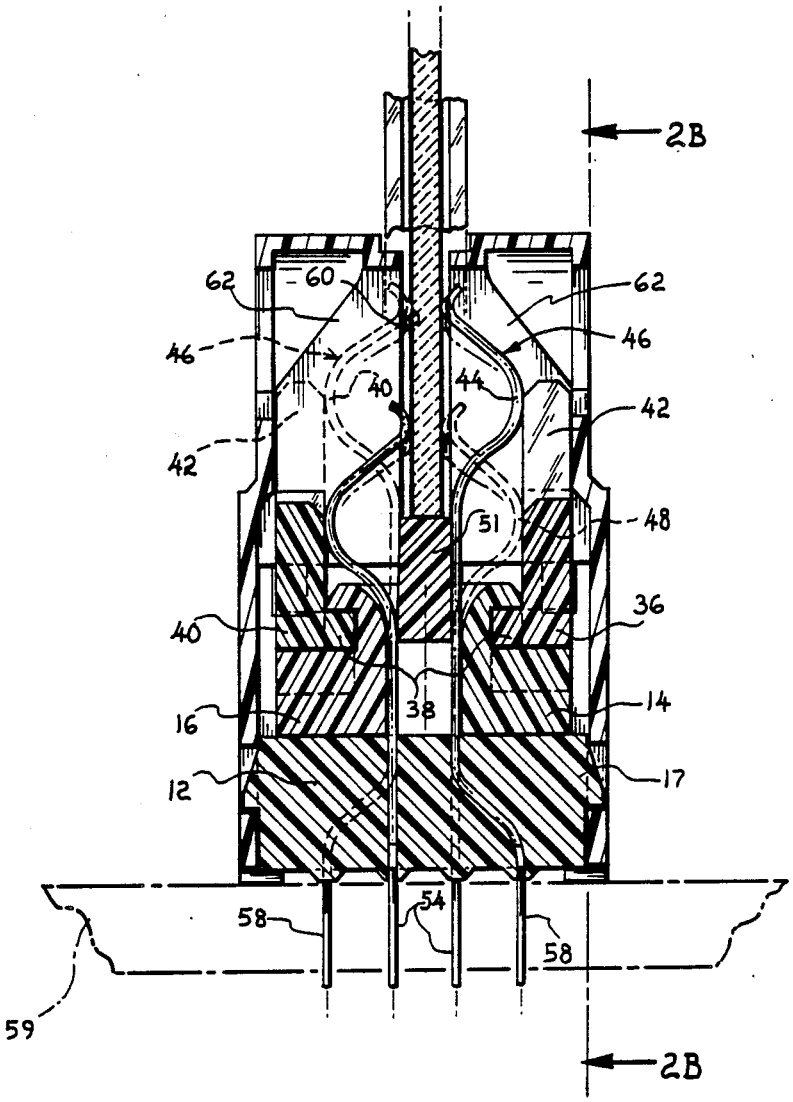
FIG. 4 is a transverse, sectional view taken on line 4—4 in FIG. 2B.

Referring to FIGS. 3 and 4, it will be seen that there is another follower 40 associated with cam 16. Thus, there are two rows of opposed terminals and an elongated follower located outside each row. At its top, each follower is recessed to present a comb-like array of thin blades 42 adapted to engage and stress bowed portions 44 of terminals 46 when followers 36,40 are raised from the position shown in FIG. 3 to the position shown in FIG. 4. Seats between the blades 42 engage and stress the bowed portions 48 of terminals 50. In each row, the bowed portions are at different levels, alternately high and low, with a high bowed portion 44 in one row opposite a low bowed portion 48 in the other row. The tops of blades 42 present high surfaces and the space between the blades present low surfaces positioned to engage the bowed portions of the terminals 46,50.

Within and extending from end wall to end wall of housing 10, there is a bar 51 beneath slot 26. As shown in FIG. 3. the shank portions 56 of terminals 46 are spaced slightly from the bar 51. Thus, the first flexing of the terminals 46,50, when the followers are raised, is adjacent terminal block 12. When the terminals contact bar 51, the bowed portions 44,48 are then stressed and the contacts at the free ends are wiped as shown in FIG. 4.

Figure 5:
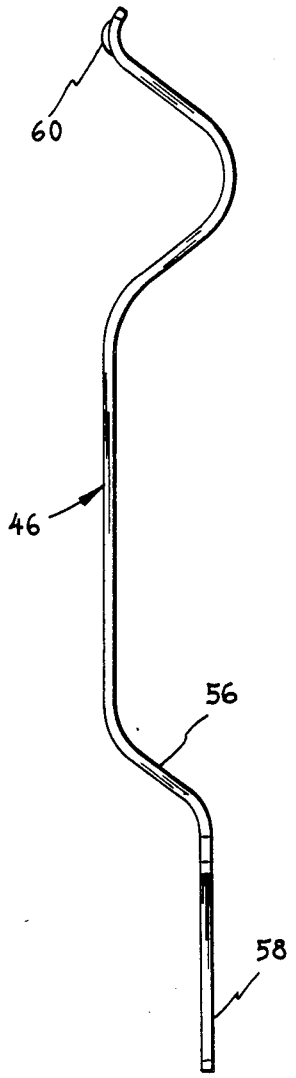
FIGS. 5 and 6 are side and end views of the long terminals shown in FIGS. 3 and 4.

Terminals 50 are relatively short and have straight shank portions 52 leading to solder tails 54. Although solder tails have been shown herein, other configurations such as wire wrap tails, pins or posts could be used. Longer terminals 46 have shank portions 56 bent outwardly (FIGS. 3–5) to solder tails 58. Shank portions 52,56 are embedded in the molded terminal block 12 and tails 54,58 project therefrom. Tails 54,58 are adapted for placement in an apertured printed circuit board 59. At its opposite end, each terminal has a card-engaging contact 60 in the form of a coined dimple and is rounded to facilitate entry into the space between partitions 62 in housing 10 as the connector is assembled and as the contacts are spread. Blades 42 on followers 36,40 are also confined between the partitions to insure alignment with the bowed portions. In addition, they prevent longitudinal movement of the followers as they are raised and lowered by cams 14,16.

Figure 6:
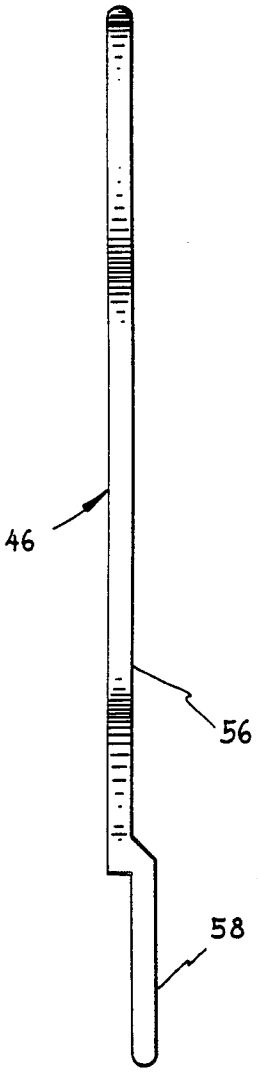

As best shown in FIG. 6, each long terminal 46 has its tail 58 offset laterally from shank portion 56. The short terminals 50 have similarly offset tails 54. From side-to-side of terminal block 12, the terminals in adjacent longitudinal rows have their tails offset longitudinally in opposite directions. Because of that feature and because of the outwardly extending shank portions 56 in the long terminals 46, there are four tails in each lateral row, i.e. for two rows of opposed terminals, there are four longitudinal rows of tails.

As shown in FIGS. 1–4 cam followers 36,40 are enclosed within one-piece, non-moving housing having side walls attached to the sides of terminal block 12 and having top and end walls which are slotted to form slot 26 for receipt of card 24. The end walls also have openings to accommodate longitudinal movement of cams 14,15 within the housing. As shown in FIGS. 3 and 4 terminals 46,50 emerge from the top of terminal block 12 in two rows, and the cams 14,15 are longitudinally movable within longitudinal channels defined by the rows of terminals, the housing 10 and the top surface of the terminal block 12.

Having thus described the invention, what is claimed as new and desired to be secured by Letters Patent is:

1. A zero insertion force connector for connecting the edge of a printed circuit card to a circuit board, having (a) opposed rows of elongated terminals having
  (i) shank portions which extend through a terminal block and present rows of projecting tails below the block adapted for connection to the circuit board,
  (ii) outwardly bowed portions above the block, and
  (iii) contacts at their upper free ends, and
(b) two cams extending lengthwise of said rows, one for each row of terminals, and an elongated cam follower for each row of terminals, each follower being positioned outside the rows and beneath the bowed portions of the terminals in one row and being adapted to engage the bowed portions when the follower is raised by the cam and to force the contacts in the two rows toward each other and into wiping contact with the edge of a printed circuit card placed between the rows.

characterized in that the cam followers are enclosed within a one-piece non-moving housing having side walls attached to the sides of the terminal block and having top and end walls which are slotted to receive the card, the terminals emerge from the top surface of the terminal block in two rows, and the cams are longitudinally movable within longitudinal channels defined by the rows of terminals, the housing and the top surface of terminal block.

2. Connector of claim 1 further characterized in that the terminal block is a molded block and shank portions of the terminals have offset portions which are embedded in the terminal block.

3. Connector of claim 2 further characterized in that a bar extends from end wall to end wall of the housing beneath the slot in the top wall, the shank portions of the terminals being spaced slightly from said bar before the followers are raised but contacting the bar as the followers are raised, whereby first flexing of the terminals as the followers are raised is adjacent the terminal block but when the terminals contact the bar the bowed portions are stressed and the contacts at the free ends are brought into wiping contact with the card.

4. The connector of claim 3 wherein the cams have a series of ramps on their upper surface which coact with similar but oppositely configured projections on the lower surface of the followers whereby the followers move vertically as the cams are moved longitudinally.

5. The connector of claim 4 wherein the terminals in each row are of two different lengths, alternately long and short, and wherein the bowed portions in each row are at different levels, alternately high and low, with a high bowed portion in one row opposite a low bowed portion in the other row and wherein each follower has a top interrupted by recesses presenting high and lower surfaces positioned to engage the bowed portions in the terminals.

6. The connector of claim 5 wherein the shank portions of the long terminals within the terminal block are bent outwardly so as to provide four longitudinal rows of tails and wherein the terminals in adjacent longitudinal rows have their tails offset longitudinally in opposite directions so as to provide lateral rows of four tails each.

* * * * *